US005677121A

United States Patent [19]

Tsuzuki

[11] Patent Number: 5,677,121

[45] Date of Patent: Oct. 14, 1997

[54] HEAT-DEVELOPABLE SILVER HALIDE INFRARED RAY-SENSITIVE MATERIAL

[75] Inventor: Hirohiko Tsuzuki, Minami-ashigara, Japan

[73] Assignee: Fuji Photo Film Co., Ltd., Kanagawa, Japan

[21] Appl. No.: 651,499

[22] Filed: May 22, 1996

[30] Foreign Application Priority Data

May 22, 1995 [JP] Japan ..... 7-122732

[51] Int. Cl.[6] ..... G03C 1/498

[52] U.S. Cl. ..... 430/619; 430/617; 430/944

[58] Field of Search ..... 430/617, 619, 430/203, 944

[56] References Cited

U.S. PATENT DOCUMENTS

| | | | |
|---|---|---|---|
| 4,152,162 | 5/1979 | Masuda et al. . | |
| 4,835,096 | 5/1989 | Lea | 430/619 |
| 4,857,439 | 8/1989 | Dedio et al. | 430/619 |
| 5,135,842 | 8/1992 | Kitchin et al. | 430/510 |
| 5,380,635 | 1/1995 | Gomez et al. | 430/510 |

FOREIGN PATENT DOCUMENTS

| | | |
|---|---|---|
| 2 721828 | 12/1977 | Germany . |
| 53-37610 | 4/1978 | Japan . |

*Primary Examiner*—Thorl Chea

*Attorney, Agent, or Firm*—Birch, Stewart, Kolasch & Birch, LLP

[57] ABSTRACT

A silver halide photographic material which is useful for photography and diagnostic imaging and exhibits excellent storability to ordinary aging, excellent image storability, high sensitivity and low $D_{min}$ is disclosed. The heat-developable silver halide infrared ray-sensitive material comprises a support having on one side of the support an emulsion layer containing a binder, a nonsensitive silver salt, a reducing agent for silver ion and silver halide grains spectrally sensitized at a wavelength within the region of from 750 to 1,400 nm, wherein the nonsensitive silver salt comprises a mixture of silver salts of at least three kinds of acids, one of the acids is behenic acid, and the content of the behenic acid in the acids is from not less than 35 to less than 90 mol %.

13 Claims, No Drawings

HEAT-DEVELOPABLE SILVER HALIDE INFRARED RAY-SENSITIVE MATERIAL

FIELD OF THE INVENTION

The present invention relates to a heat-developable silver halide infrared ray-sensitive material, particularly to a photographic material for a laser imagesetter or a laser imager (hereinafter referred to as an "LI photographic material"), and more particularly to a one side-sensitive photographic material comprising an LI photographic material which has excellent graininess and gives a highly definite image, thereby faithfully reproducing image information.

BACKGROUND OF THE INVENTION

In the medical field, a reduction in waste of treating solution has been seriously desired from the viewpoint of environmental protection and space saving in recent years. Progress has been therefore required regarding the technology of photo-thermographic materials for diagnosis and photography which can be efficiently exposed to light with the aid of a laser imagesetter or a laser imager to form a clear black image with high resolution and high definition. These heat-developable photographic materials would supply customers with a heat-processing system which needs no use of a solution containing processing chemicals and can be easily processed without spoiling the environment.

On the other hand, the technology of the semiconductor laser which has been recently making a rapid progress makes it possible to miniaturize image output devices for medical uses. As might be expected, techniques for the heat-developable silver halide infrared ray-sensitive materials for which a semiconductor laser can be used as a light source are also developed. Techniques for the spectral sensitization thereof are disclosed in JP-B-3-10391 (The term "JP-B" as used herein means an "examined Japanese patent publication"), JP-B-6-52387, JP-A-5-3414323 (The term "JP-A" as used herein means an "unexamined published Japanese patent application"), JP-A-6-194781 and JP-A-6-301141. Further, techniques for the antihalation thereof are disclosed in JP-A-7-13295 and U.S. Pat. No. 5,380,635. The photographic materials which are presupposed to be exposed to infrared rays are greatly reduced in the absorption of the visible region owing to sensitizing dyes and antihalation dyes to which facilitates the preparation of substantially colorless photographic materials.

However, spectrally sensitizing dyes absorbing infrared rays generally have strong reducing power to reduce silver ion in the photographic materials, because of their high HOMO (highest occupied molecular orbital) level, and therefore have a tendency to worsen fog in the photographic materials. These photographic materials also have a disadvantage in that their performances markedly change when subjected to storage under high temperature and high humidity or storage over a long period of time.

As a means for solving the problem regarding storability of wet type photographic materials, it is known that these materials can be stabilized by adding compounds capable of forming slightly soluble salts or complexes with silver ion so that the salts or complexes can be adsorbed by silver halide grains. The compounds used for the above described purpose are described in JP-A-2-68539, from page 10, lower left column, line 17 to page 11, upper left column, line 7 and from page 3, lower left column, line 2 to page 4, lower left column. On the other hand, a number of nonsensitive silver sources, besides silver halide grains, can be employed for the heat-developable photographic materials, and the adsorption of the above-described compounds on silver halide grains, which is effectively carried out in the wet type photographic materials, is disturbed in the heat-developable photographic materials, failing to achieve the effect.

SUMMARY OF THE INVENTION

An object of the present invention is to provide a heat-developable silver halide infrared ray-sensitive material which has excellent storability.

The object of the present invention has been achieved by providing a heat-developable silver halide infrared ray-sensitive material comprising a support having on one side of the support an emulsion layer containing a binder, a nonsensitive silver salt, a reducing agent for silver ion and silver halide grains spectrally sensitized at a wavelength within the region of from 750 to 1,400 nm, wherein the nonsensitive silver salt comprises a mixture of silver salts of at least three kinds of acids, one of the acids is behenic acid, and the content of the behenic acid in the acids is from not less than 35 to less than 90 mol %.

DETAILED DESCRIPTION OF THE INVENTION

An infrared sensitizing dye for sensitizing the silver halide grains for use in the present invention is described below. Any dye which is adsorbed by silver halide grains and spectrally sensitize the grains in any wavelength region within from 750 to 1,400 nm can be used in the present invention. Specifically, photosensitive silver halide can be advantageously spectrally sensitized by various known dyes such as cyanine dyes, merocyanine dyes, styryl dyes, hemicyanine dyes, oxonol dyes, hemioxonol dyes and xanthene dyes. Useful cyanine dyes contain a basic nucleus such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes preferably contain, in addition to the above described basic nucleus, an acidic nucleus such as a thiohydantoin nucleus, a rhodanine nucleus, an oxazolidinedione nucleus, a thiazolinedione nucleus, a barbituric acid nucleus, a thiazolinone nucleus, a malononitrile nucleus and a pyrazolone nucleus. Among the above-described cyanine dyes and merocyanine dyes, dyes containing an imino group or a carboxyl group are particularly effective. Particularly, sensitizing dyes used in the present invention may be suitably selected among known dyes as described in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-3414323, JP-A-6-194781, and JP-A-6-301141. These dyes can be placed in close proximity to a photocatalyst by known methods. The sensitizing dyes are generally used in an amount of from about $10^{-5}$ to about 1 mol per mol of silver halide. Desired spectral sensitization spectra can also be obtained by mixing a plurality of dyes.

Spectrally sensitizing dyes used in the present invention are represented by the following formulas. However, the present invention is not limited by these compounds.

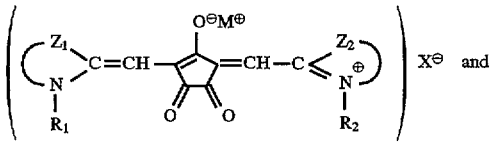

(I)

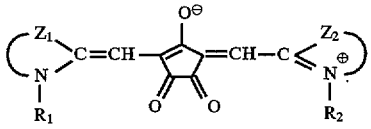

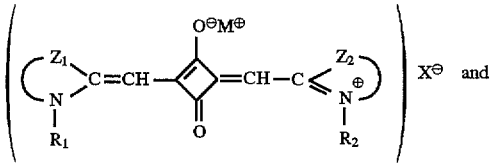

(II)

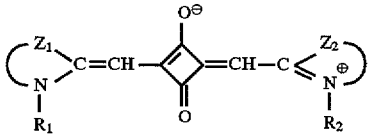

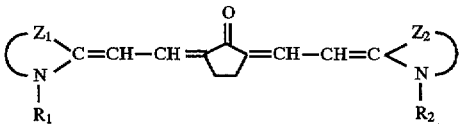

(III)

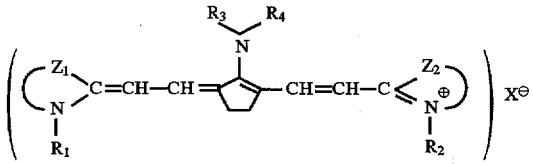

(IV)

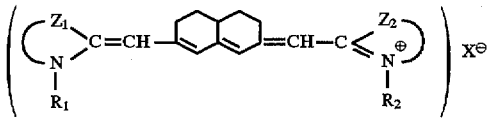

(V)

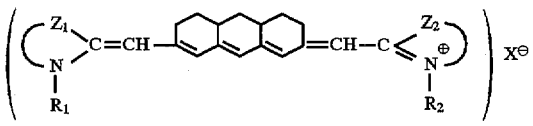

(VI)

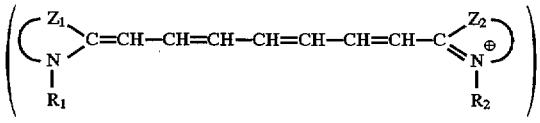

(VII)

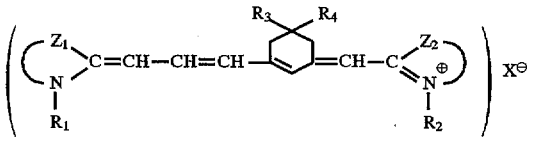

(VIII)

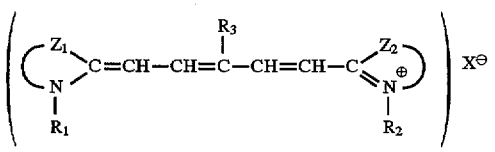

(IX)

-continued

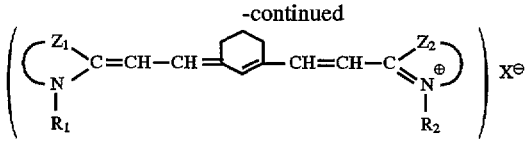

(X)

wherein $R_1$ and $R_2$ each represents an alkyl group, a substituted alkyl group, an aryl group, a substituted aryl group, an ally group, an aralkyl group, a substituted aralkyl group or a cycloalkyl group; $Z_1$ and $Z_2$ each represents a group of atoms necessary for completing the formation of a 5- or 6-membered heterocyclic ring; $X^-$ represents an anion, with the proviso that $X^-$ is omitted in cases where $R_1$ and/or $R_2$ themselves contain an anion; $M^+$ represents a cation; and $R_3$ and $R_4$ each represents an alkyl group, a substituted alkyl group, an aryl group, a substituted aryl group or a cycloalkyl group, or $R_3$ and $R_4$ may combine with each other to form a cycloalkylene skeleton.

$R_1$ to $R_4$ has generally from 2 to 24 carbon atoms, preferably from 3 to 20 carbon atoms. The substituent for the above described substituted group represented by $R_1$ to $R_4$ is not particularly limited. Examples thereof include halogen atoms, a hydroxyl group, a carbonyl group, a nitro group and a cyano group. Preferred examples of $R_3$ and $R_4$ include an alkyl group having from 1 to 8 carbon atoms, and an aryl group.

The structures of the dyes for use in the present invention are described in more detail below. $R_1$ and $R_2$, which may be the same or different, each can be selected among a group of known substituent groups which generally link to the cyanine nitrogen atoms of cyanine dyes, and particularly selected among the group of substituent groups which fall into the same category with those described in JP-B-51-41061.

Examples of particularly effective substituent groups represented by $R_1$ and $R_2$ include an alkyl group such as methyl, ethyl, propyl, isopropyl, butyl and isobutyl; a carboxyalkyl group such as carboxymethyl, carboxyethyl, carboxypropyl and carboxybutyl; a sulfoalkyl group such as sulfoethyl, sulfopropyl and sulfobutyl; a sulfatealkyl group such as sulfatepropyl and sulfatebutyl; a hydroxyalkyl group; an N-substituted alkyl group such as N-(methylsulfonyl)-carbamylmethyl and γ-(acetylsulfamyl)butyl group; an allyl group; an aralkyl group such as benzyl; a substituted aralkyl group such as carboxybenzyl and sulfobenzyl; an aryl group such as phenyl; a substituted aryl group such as carboxyphenyl and sulfophenyl; and a cycloalkyl group such as cyclohexyl.

$Z_1$ and $Z_2$, which may be the same or different, each represents a group of atoms necessary for completing the formation of a 5- or 6-membered heterocyclic ring, which can arbitrarily selected among a series of heterocyclic rings described, particularly, in JP-B-51-41061.

Examples of typical skeletons of such heterocyclic rings include nuclei of a thiazole type such as thiazole, 4-methylthiazole, 4-phenylthiazole and 4,5-dimethylthiazole; nuclei of a benzothiazole type such as benzothiazole, 5-chlorobenzothiazole, 5,6-dimethylbenzothiazole and 5,6-dimethoxybenzothiazole; nuclei of a naphthothiazole type such as naphtho[2,1-d]thiazole, naphtho[1,2-d]thiazole and 5-methoxynaphtho[1,2-d]thiazole; nuclei of a thionaphthene[7,6-d]thiazole type such as 7-methoxythionaphthene[7,6-d]-thiazole; nuclei of a oxazole type such as 4-methyloxazole, 5-methyloxazole, 4-phenyloxazole and 4,5-dimethyloxazole; nuclei of a benzoxazole type such as benzoxazole, 5-chloro-benzoxazole, 5-methylbenzoxazole, 5,6-dimethylbenzoxazole, 5-methoxybenzoxazole and 5-hydroxybenzoxazole; nuclei of a naphthoxazole type such as naphtho[1,2-d]oxazole; nuclei of a selenazole type such as 4-methylselenazole; nuclei of a benzoselenazole type such as benzoselenazole, 5-methyl-benzoselenazole and 5-methoxybenzoselenazole; nuclei of a naphthoselenazole type such as naphtho[2,1-d] selenazole; nuclei of a thiazoline type such as thiazoline, 4-methyl-thiazoline and 4,4-bis(hydroxymethyl)thiazoline; nuclei of an oxazoline type; nuclei of a selenazoline type; nuclei of 4-quinoline type such as quinoline, 6-methylquinoline, 6-ethoxyquinoline and 6-naphthoxyquinoline; nuclei of an 1-isoquinoline type; nuclei of a 3-isoquinoline type; nuclei of a 3,3-dialkylindolenine type such as 3,3-dimethylindolenine, 3,3-dimethyl-5-chloroindolenine and 3,3,5-trimethylisoindolenine; nuclei of a pyridine type such as pyridine and 5-methylpyridine; nuclei of a benzimidazole type such as 1-ethyl-5,6-dichlorobenzimidazole, 1-hydroxyethyl-5,6-dichlorobenzimidazole, 1-ethyl-5-chlorobenzimidazole, 1-ethyl-5-fluoro-6-cyanobenzimidazole, 1-ethyl-5-ethylsulfonyl-benzimidazole, 1-ethyl-5-methylsulfonylbenzimidazole, 1-ethyl-5-trifluoromethylsulfonylbenzimidazole and 1-ethyl-5-trifluoromethylsulfinylbenzimidazole.

$X^-$ represents an anion such as chloride ion, bromide ion, iodide ion, perchlorate ion, benzenesulfonate ion, p-toluenesulfonate ion, methyl sulfate ion, ethyl sulfate ion and propyl sulfate ion. However, $X^-$ does not exist, when $R_1$ and/or $R_2$ themselves contain anions such as $—SO_3^-$, $—OSO_3^-$, $—COO^-$, $—SO_2N^-—$, $—SO_2—N^-—CO—$ and $—SO_2—N^-—SO_2—$.

$M^+$ represents a cation such as hydrogen ion, metal ions, or inorganic or organic onium ions (ammonium, pyridinium and the like).

In the present invention, $R_3$ and $R_4$, which may be the same or different, can be selected among the group of the substituent groups which fall into the same category with $R_1$ and $R_2$ in principle. Further, $R_3$ and $R_4$ may combine with each other to form a cycloalkylene skeleton such as cyclohexylene and cyclopentylene. The cycloalkylene skeleton may be partially replaced by a heteroatom such as oxygen and nitrogen to form, for example, a morpholine or a piperazine skeleton.

Examples of the structures of dyes represented the above-described formulas are shown below.

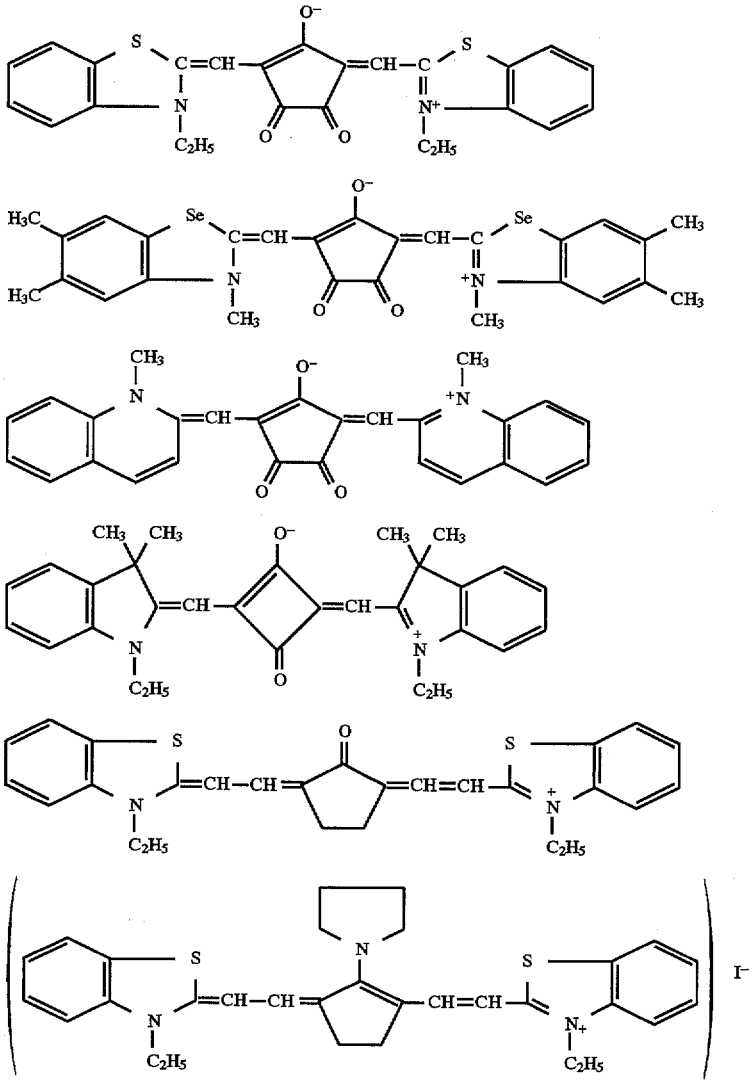

-continued
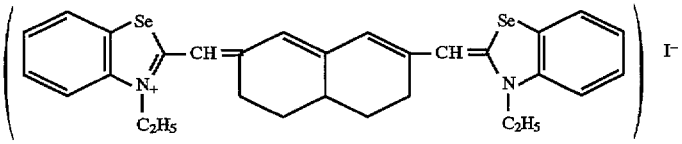
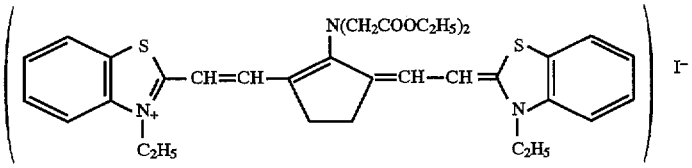
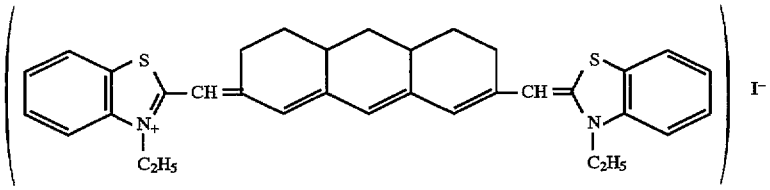
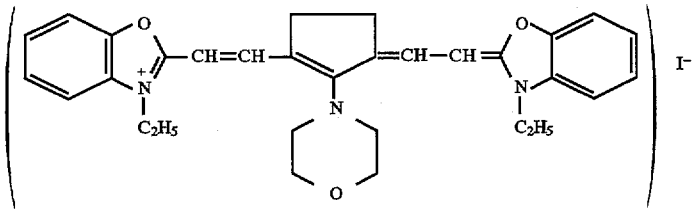
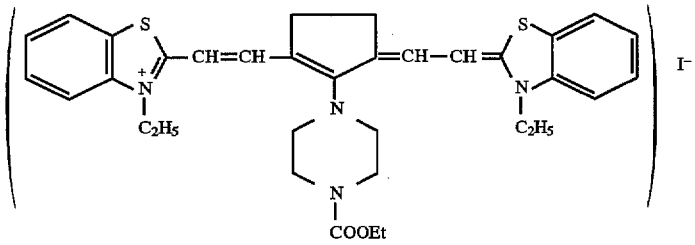
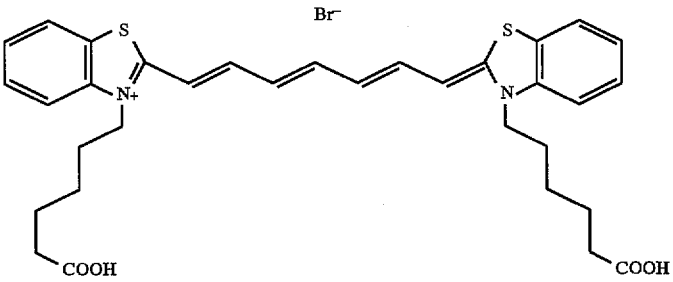
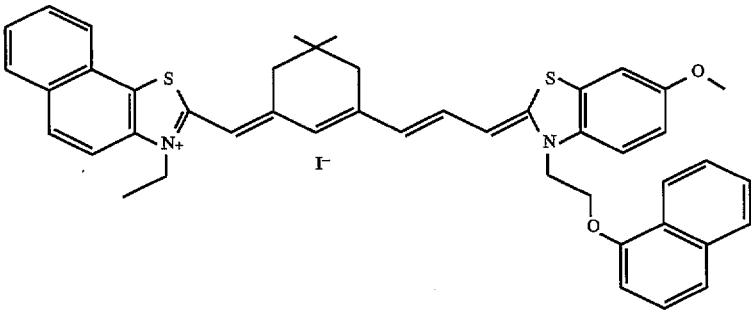

-continued

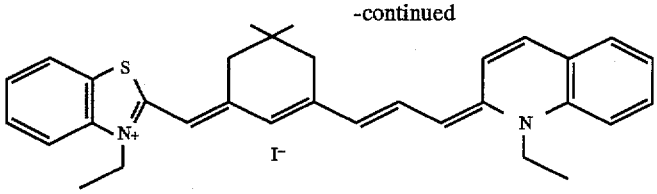

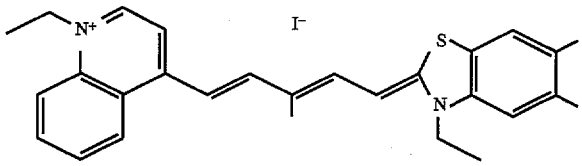

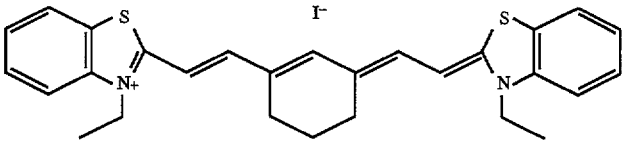

The nonsensitive silver salt for use in the present invention is relatively stable to light, but forms a silver image when heated to 80° C. or higher in the presence of an exposed photocatalyst (photographic silver salt) and a reducing agent. The nonsensitive silver salt is a mixture of silver salts of 3 or more kinds of acids, which contains from 35 to 90 mol %, preferably from 40 to 80 mol %, and more preferably from 40 to 70 mol % of behenic acid. Any acids which can form a nonsensitive silver salt capable of reducing silver ion together with behenic acid can be used as the acids other than behenic acid. The nonsensitive salt may be a complex of an organic or inorganic silver salt in which the overall stability constant of a ligand(s) ranges from 4.0 to 10.0. Preferred acids are carboxyl group-containing organic compounds which include aliphatic carboxylic acids and aromatic carboxylic acids. However, acids used in the present invention are not limited to these carboxylic acids. Examples of preferred aliphatic carboxylic acids include oleic acid, lauric acid, caproic acid, myristic acid, palmitic acid, stearic acid, arachic acid, maleic acid, fumaric acid, tartaric acid, linoleic acid, butyric acid and camphoric acid. It is particularly preferred that the mixture of acids comprises 2 or more kinds of long-chain higher aliphatic carboxylic acids which contain from 10 to 30 carbon atoms and preferably from 15 to 28 carbon atoms, besides 22 carbon atoms that behenic acid contains. Stearic acid and arachic acid are furthermore preferably contained in the mixture of acids. It is particularly preferred that the mixture of acids comprises behenic acid, stearic acid and arachic acid and the total content of stearic acid and arachic acid is 10 to 200 mol %, based on the amount of behenic acid. The coating amount of the nonsensitive silver salt is preferably from 0.5 to 5 $g/m^2$ and more preferably from 1 to 3 $g/m^2$ in weight of silver.

A backing layer may be provided on the side of the support opposite the emulsion layer. The backing layer for use in the present invention is preferably an antihalation layer which has preferably an optical density of from 0.3 to 2 and more preferably from 0.5 to 2 at maximum absorption in the 750 to 1,400 nm infrared region and has preferably an optical density of from 0.001 to 0.5 and more preferably from 0.001 to 0.3 in the visible region.

In cases where antihalation dyes are used in the present invention, any dye which have desired absorption in the 750 to 1,400 region and sufficiently low absorption in the visible region can be used to give a desired shape of absorption spectra for the above-described backing layer. Examples of those dyes include compounds described in JP-A-7-13295 and U.S. Pat. No. 5,380,635 and compounds described in JP-A-2-68539, from page 13, lower left column, line 1 to page 14, lower left column, line 9 and JP-A-3-24539, from page 14, lower left column to page 16, lower right column. However, the present invention is not limited by these compounds.

Preferred antihalation dyes for use in the present invention are shown below, but the present invention is not limited by these compounds.

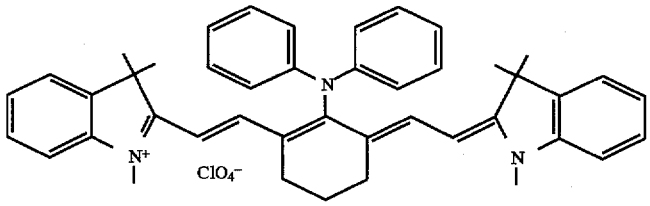

-continued

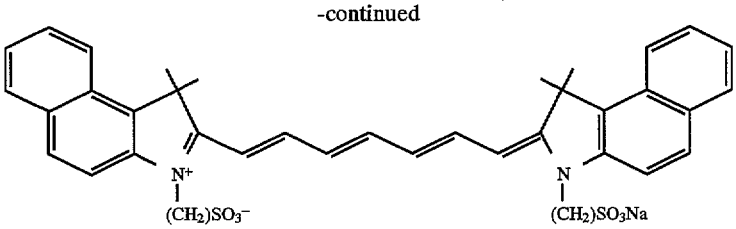

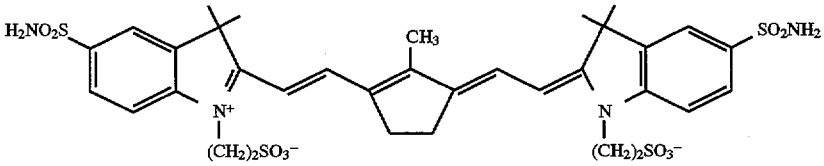

$HN^+(C_2H_5)(CH(CH_3)_2)_2$

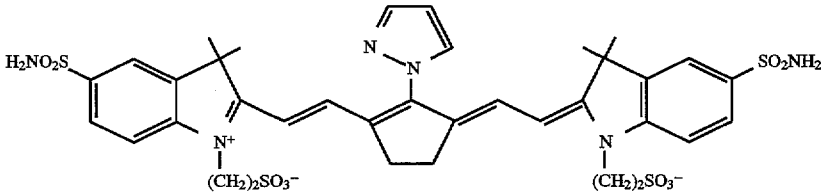

$HN^+(C_2H_5)(CH(CH_3)_2)_2$

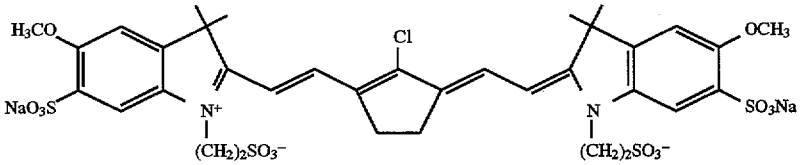

$HN^+(C_2H_5)(CH(CH_3)_2)_2$

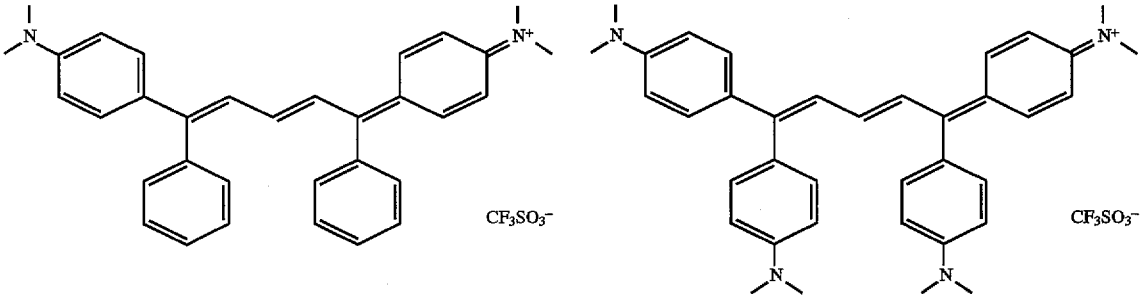

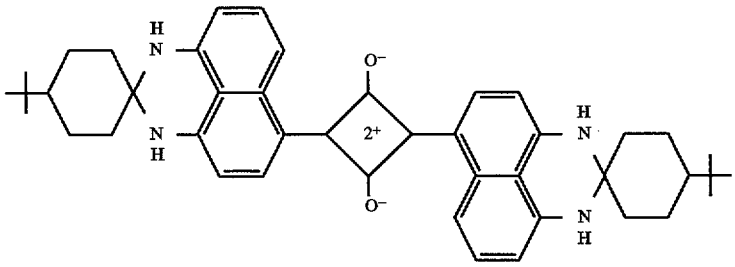

The photo-thermophotographic Dry Silver emulsion layer for use in the present invention is formed on the support, and may comprises one or more layers. The single-layer type emulsion layer contains a nonsensitive silver salt, silver halide, a reducing agent, a binder and additional materials to be used as needed, for example, a toning agent, a covering additive and other auxiliaries. In the two-layer type emulsion layer, the first emulsion layer (usually the layer next to a support) must contain a nonsensitive silver salt and silver halide, whereas the other components must be contained in the second layer or in both of the layers. Alternatively, a two-layer type emulsion layer comprising a single emulsion layer containing all necessary components for the emulsion layer of the present invention and a protective top coat is also possible. In a multi-color photographic Dry Silver system, each emulsion layer for respective color may be the above described two-layer type emulsion layer, or may be a single-layer type emulsion layer containing all necessary components as described in U.S. Pat. No. 4,708,928. In multi-dye, multi-color photo-thermographic products, the respective emulsion layers are separated from one another by providing a functional or nonfunctional barrier layer between the respective layers as described in U.S. Pat. No. 4,460,681.

In some cases, it may be advantageous to add a mercury (II) salt to an emulsion layer as an antifoggant, although the addition of the mercury (II) salt is not always necessary to practice the present invention. Preferred mercury (II) salts for this purpose are mercury acetate and mercury bromide.

The silver halide may be any photosensitive silver halides such as silver bromide, silver iodide, silver chloride, silver bromoiodide, silver chlorobromoiodide and silver chlorobromide. These silver halides are sensitive, and may have arbitrary crystal forms such as cubic, orthrhombic, plate-like and tetrahedral. However, the crystal form is not limited to these forms, and epitaxial growth of the crystals on these forms is also acceptable. The content of the silver halide is preferably from 1 to 50 mol %, more preferably from 3 to 30 mol %, based on the nonsensitive silver salt.

The silver halide for use in the present invention can be used without making any modification. However, they can be subjected to chemical sensitization by use of a chemical sensitizer such as a compound containing sulfur, selenium, tellurium or the like, a compound containing gold, platinum, palladium, rhodium, iridium or the like, or a reducing agent such as stannous halides; or by combination with these compounds. Procedures of the chemical sensitization are described in detail in T. N. James, *THE THEORY OF THE PHOTOGRAPHIC PROCESS*, the fourth edition, Chapter 5, pp. 149–169.

The silver halide can be added to the emulsion layer in an appropriate manner to be placed in close proximity to the nonsensitive silver salt so as to act as a catalyst on the nonsensitive silver salt. The silver halide and the organic silver salt, which are formed in binders or "preformed", respectively, are mixed prior to their use to prepare a covering solution, or it is also effective to mix both of them in a ball mill for a long period of time. There is also an effective process comprising the conversion of a part of the nonsensitive silver salt into a silver halide by adding a halogen-containing compound to the nonsensitive silver salt prepared. These processes for preparing or mixing the silver halide and the nonsensitive silver salt are already known in the field of this technology, and described in *Research Disclosure,* June, 1978, Item No. 17029 and U.S. Pat. No. 3,700,458.

In the present invention, silver halide emulsions preformed need not be washed or may be washed to remove soluble salts. In the latter case, the soluble salts may be removed by coagulation by cooling and leaching, or the emulsions may be coagulated and washed according to procedures described, for example, in U.S. Pat. Nos. 2,618,556, 2,614,928, 2,565,418, 3,241,969 and 2,489,341.

As a part of the nonsensitive silver salt, silver salts of compounds containing a mercapto group or a thione group and derivatives thereof can also be used. Among these compounds, examples of preferred compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)benzothiazole, silver salts of thioglycollic acids such as silver salts of S-alkylthioglycollic acids (The alkyl group has from 12 to 22 carbon atoms), silver salts of dithiocarboxylic acids such as silver dithioacetate, silver salts of thioamides, a silver salt of 5-carboxyl-1-methyl-2-phenyl-4-thiopyridine, a silver salt of mercaptotriazine, a silver salt of 2-mercaptobenzoxazole, silver salts described in U.S. Pat. No. 4,123,274, for example, silver salts of 1,2,4-mercaptothiazole derivatives such as a silver salt of 3-amino-5-benzylthio-1,2,4-thiazole, and silver salts of thione compounds such as 3-(3-carboxyethyl)-4-methyl-4-thiazoline-2-thione described in U.S. Pat. No. 3,301,678. Further, silver salts of imino group-containing compounds can also be used. Among these compounds, examples of preferred ones include silver salts of benzotriazoles and their derivatives, for example, silver salts of benzotriazoles such as silver methylbenzotriazole, silver salts of halogen-substituted benzotriazoles such as silver 5-chlorobenzotriazole, silver salts of 1,2,4-triazole or 1-H-tetrazole as described in U.S. Pat. No. 4,220,709, and silver salts of imidazole and its derivatives. Various silver acetylide compounds can also be used, which are described, for example, in U.S. Pat. Nos. 4,761,361 and 4,775,613. The above described silver salts and derivatives thereof can be used in an amount of from 0 to 20% by weight based on the total weight of silver.

The reducing agent for the nonsensitive silver salt may be any substance, preferably an organic substance, which can reduce silver ion to metallic silver. Although commonly used photographic developers such as phenidone, hydroquinone and catechol are useful, hindered phenol compounds are preferably used as the reducing agents. The content of the reducing agent in the emulsion layer is preferably from 1 to 10% by weight based on the weight of the layer. When the reducing agent is added to a layer other than the emulsion layer constituting a multi-layered emulsion layer, the content thereof is preferably from about 2 to about 15%, based on the emulsion layer.

In the Dry Silver system, a wide variety of reducing agents are disclosed, which include amidooximes such as phenylamidooxime, 2-thienylamidooxime and p-phenoxyphenylamidooxime; azines such as 4-hydroxy-3,5-dimethoxybenzaldehydeazine; combinations of an aliphatic carboxylic acid arylhydrazide and ascorbic acid such as a combination of 2,2'-bis(hydroxymethyl)propionyl-β-phenylhydrazine and ascorbic acid; combinations of a polyhydroxybenzene, a hydroxylamine, a reductone and/or a hydrazine such as a combination of hydroquinone, bis(ethoxyethyl)hydroxylamine, and piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine and a sulfonamidophenol such as a combination of phenothiazine and 2,6-dichloro-4-benzenesulfonamidophenol; α-cyanophenylacetic acid derivatives such as ethyl α-cyano-2-methylphenylacetate and ethyl α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol and an 1,3-dihydroxybenzene derivative such as 2,4-dihydroxybenzophenone and 2',4'-dihydroxyacetophenone; 5-pyrazolones such as 3-methyl-1-phenyl-5-pyrazolone; reductones such as dimethylaminohexose reductone, anhydrodihydroaminohexose reductone and anhydrodihydropiperidonehexose reductone; reducing agents of a sulfonamidophenol type such as 2,6-dichloro-4-benzenesulfonamidophenol and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol) and 2,2-bis(3,5-dimethyl-4-hydroxyphenyl)propane; ascorbic acid derivatives such as 1-ascorbyl palmitate and ascorbyl stearate; aldehydes and ketones such as benzil and biacetyl; and 3-pyrazolidones and some kinds of indane-1,3-diones.

In some cases, an additive known as a toning agent to improve image quality may be advantageously added in the emulsion layer. The toning agent may be contained in an amount of 0.1 to 10% by weight based on the weight of the total components containing silver. The toning agent is well-known material in the photographic technology as described in U.S. Pat. Nos. 3,080,254, 3,847,612 and 4,123,282.

Examples of the toning agent include phthalimide and N-hydroxyphthalimide; cyclic imides such as succinimide, pyrazoline-5-one, quinazolinone, 3-phenyl-2-pyrazoline-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as (N,N-dimethylaminomethyl)phthalimide and N,N-(dimethylamino-methyl)naphthalene-2,3-dicarboxyimide; blocked pyrazoles, isothiuroniumderivatives and some kinds of light-fading agents such as N,N'-hexamethylenebis(1-carbamoyl-3,5-dimethylpyrazole), 1,8-(3,6-diazaoctane)bis-(isothiuronium-trifluoroacetate) and 2-(tribromomethylsulfonyl)-benzothiazole; 3-ethyl-5[(3-ethyl-2-benzothiazolinylidene)-1-methylethylidene]-2-thio-2,4-oxazolidinedione; phthalazinone, phthalazinone derivatives or their metal salts, 4-(1-naphthyl)phthalazinone, 6-chlorophthalazinone, 5,7-dimethoxy-phthalazinone and 2,3-dihydro-1,4-phthalazinedione and their derivatives; combinations of phthalazinone and a phthalic acid derivative such as phthalic acid, 4-methylphthalic acid, 4-nitrophthalic acid and tetrachlorophthalic anhydride; quinazolinedione, benzoxazine, naphthoxazine and their derivatives; rhodium complexes such as ammonium hexachlororhodate (III), rhodium bromide, rhodium nitrate, and potassium hexachlororhodate (III), which act not only as toning agents but also as a halide ion source for forming silver halide in situ; inorganic peroxides and persulfates such as ammonium peroxydisulfide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines such as 2,4-dihydroxypyrimidine and 2-hydroxy-4-aminopyrimidine and asym-triazines; and azauracil and tetrazapentalene derivatives such as 3,6-dimercapto-1,4-diphenyl-1H,4H-2,3a,5,6a-tetrazapentalene and 1,4-di(o-chlorophenyl)-3,6-dimercapto-1H,4H-2,3a,5,6a-tetrazapentalene.

Many methods for forming a color image by use of the Dry Silver system are known in the field of this technology. Such methods include combinations of silver benzotriazole, known magenta, yellow or cyan dye-forming couplers, an aminophenol developing agent, a base-releasin agent such as guanidinium trichloroacetate and silver bromide blended in poly(vinyl butyral) as described in U.S. Pat. Nos. 4,847,188 and 5,064,742; a preformed dye-releasing system as described in U.S. Pat. No. 4,678,739; combinations of silver bromoiodide, a sulfonamidophenol reducing agent, silver behenate, poly(vinyl butyral), an amine such as n-octadecylamine and a divalent and tetravalent cyan, magenta or yellow dye-forming coupler; a leuco dye base which form a dye image by oxidation (for example, Malachite Green, Crystal Violet and Pararosaniline); combinations of silver halide formed in situ, silver behenate, 3-methyl-1-phenylpyrazolone and N,N'-dimethyl-p-phenylenediamine hydrochloride; blending of a phenolic leuco dye reducing agent such as 2-[3,5-di(t-butyl)-4-hydroxyphenyl]-4,5-diphenylimidazole and bis(3,5-di-t-butyl-4-hydroxyphenyl)phenylmethane; blending of an azomethine dye or an azo dye reducing agent; the silver dye bleaching method (a method for obtaining a positive dye image having good stability in which an element comprising, for example, silver behenate, behenic acid, poly(vinyl butyral), an emulsion of silver bromoiodide deflocculated by poly-(vinyl butyral), 2,6-dichloro-4-benzenesulfonamidophenol, 1,8-(3,6-diazaoctane)bis (isothiuronium-p-toluenesulfonate) and an azo dye is exposed to light and heat-treated to form a negative silver image having a uniform dispersion of the dye, and subsequently, the heat treatment product is laminated to an acidic activating agent sheet comprising polyacrylic acid, thiourea and p-toluenesulfonic acid and heated to obtain a sufficiently fixed positive color image); and formation of a dye image by reacting an amine such as aminoacetoanilide (formation of a yellow dye), 3,3'-dimethoxybenzidine (formation of a blue dye) or sulfanilide (formation of a magenta dye) with a reducing agent in which an oxidized form of 2,6-dichloro-4-benzenesulfonamidophenol or the like is blended. A neutral dye image is obtained by addition of an amine such as behenylamine and p-anisidine.

The oxidation of the leuco dye in such silver halide systems for coloration is disclosed in U.S. Pat. Nos. 4,021,240, 4,374,821, 4,460,681 and 4,883,747. Typical examples of the leuco dye suitably used in the present invention include bisphenol and bisnaphthol leuco dyes, phenol type leuco dyes, indoaniline leuco dyes, imidazole leuco dyes, azine leuco dyes, oxazine leuco dyes, diazine leuco dyes and thiazine leuco dyes. However, the leuco dye for use in the present invention is not limited to these leuco dyes. Preferred kinds of the dye are described in U.S. Pat. Nos. 4,460,681 and 4,594,307.

One kind of leuco dyes useful in the present invention is dyes derived from imidazole dyes. The imidazole leuco dyes are described in U.S. Pat. No. 3,985,565. Other leuco dyes useful in the present invention include the so-called "color-producing dyes". These dyes are prepared by the oxidative coupling of p-phenylenediamine with a phenol or aniline compound. The leuco dyes of this kind are described in U.S. Pat. No. 4,594,307. Leuco color-producing dyes containing a short-chain carbamoyl protecting group are described in U.S. patent application Ser. No. 07/939,093 filed by the present applicants.

The third kind of dyes useful for the present invention is "aldazine" and "ketazine" dyes. Dyes of this kind are described in U.S. Pat. Nos. 4,587,211 and 4,795,697. Leuco dyes of other preferred kind are those which contain a reduction type nucleus such as diazine, oxazine and thiazine. The leuco dyes of this kind can be prepared by reducing or acylating a corresponding dye of the coloring form. Processes for the preparation of the leuco dyes of this kind are described in JP-A-52-89131 and U.S. Pat. Nos. 2,784,186, 4,439,280, 4,563,415, 4,570,171, 4,622,395 and 4,647,525.

Other kinds of dye-releasing substances which form dyes by oxidation are preformed dye-releasing substances and redox dye-releasing substances. These substances release preformed dyes, when the reducing agent for the nonsensitive silver compounds undergo oxidation. Examples of these substances are disclosed in U.S. Pat. No. 4,981,775 by Swain. These arbitrary leuco dyes of the present invention are prepared according procedures described in H. A. Lubs, *THE CHEMISTRY OF SYNTHETIC DYES AND PIGMENTS*, Hafner, New York, N.Y., 1955, Chapter 5; H. Zollinger, *COLOR CHEMISTRY; SYNTHESIS, PROPERTIES AND APPLICATIONS OF ORGANIC DYES AND PIGMENTS*, VCH, New York, N.Y., pp. 67–73, 1987; U.S. Pat. No. 5,149,807; and European Patent Publication No. 0244399 A.

The silver halide emulsion of the present invention can be more protected from forming additional fog and from deterioration in sensitivity thereof during storage. Appropriate antifoggants, stabilizers and precursors of stabilizers, which can be used singly or as mixtures, include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazols described in U.S. Pat. No. 3,287,135, sulfocatechols described in U.S. Pat. No. 3,235,652, oximes, nitrons and nitroindazoles described in British Patent 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365, and 4,459,350, and phosphor compounds described in U.S. Pat. No. 4,411,985.

The stabilized emulsions of the present invention may contain a plasticizer and a lubricant such as a polyhydric alcohol (for example, glycerin and a diol as described in U.S. Pat. No. 2,960,404), fatty acids and their esters described in U.S. Pat. Nos. 2,588,765 and 3,121,060, and a silicone resin described in British Patent 955,061. The photo-thermographic element of the present invention can contain an image-dye stabilizer. Examples of such an image-dye stabilizer are described in British Patent 1,326,889 and U.S. Pat. Nos. 3,432,300, 3,698,909, 3,574,627, 3,573,050, 3,764,337 and 4,042,394.

The emulsion layer or a protective layer thereof of the present invention can contain a light absorbing substance and a filter dye as described in U.S. Pat. Nos. 3,253,921, 2,274,782, 2,527,583 and 2,956,879 to be used as a photographic element. That is, the dye can be mordanted as described, for example, in U.S. Pat. No. 3,282,699. The above-described emulsion layer or the protective layer thereof can contain a flatting agent such as starch, titanium dioxide, zinc oxide, silica, and polymer beads including beads described in U.S. Pat. Nos. 2,992,101 and 2,701,245. The degree of matting at an emulsion surface is not limited as long as a stardust trouble is not developed. However, the Beck smoothness is preferably from 1,000 to 10,000 seconds, and more preferably from 2,000 to 10,000 seconds. Similar flatting agents can also be added to the backing layer or the protective layer thereof. The degree of matting of the backing layer is preferably from 10 to 250 seconds, and more preferably 50 to 180 seconds in Beck smoothness.

The stabilized emulsion of the present invention can be used for a photo-thermographic element comprising an antistatic or a conducting layer. For example, the emulsion can be used in a photo-thermographic element comprising soluble salts such as chlorides and nitrates, a metal depositing layer and a layer containing an ionic polymer as described in U.S. Pat. Nos. 2,861,056 and 3,206,312 or an insoluble inorganic salt as described in U.S. Pat. No. 3,428,451.

Binders used in the present invention can be arbitrarily selected among known natural or synthetic resins such as gelatin, poly(vinyl acetal), poly(vinyl chloride), poly(vinyl acetate), cellulose acetate, polyolefins, polyesters, polystyrene, polyacrylonitrile and polycarbonates. As a matter of course, copolymers and terpolymers are to be included in this category. Preferred polymers are poly(vinyl butyral), butyl ethyl cellulose, methacrylate copolymers, maleic anhydride ester copolymers, polystyrene and butadiene-styrene copolymers. These polymers can be used in combination with 2 or more kinds thereof, as needed. The polymers are used in an amount sufficient to hold the other components therein. That is, they are used in ranges effective to function as binders. Manufacturers of the industry can pertinently determine the effective ranges. To hold at least the organic silver salt, the proportion of the binder to the organic silver salt preferably ranges from 15:1 to 1:2, and more preferably from 8:1 to 1:1. The photo-thermosensitive emulsions containing the stabilizers of the present invention can be coated on various supports. Examples of typical supports include polyester films, undercoated polyester films, poly(ethylene terephthalate) films, cellulose nitrate films, cellulose ester films, poly(vinyl acetal) films, polycarbonate films and their related or resinous materials, glass, paper and metals. Typical examples of the support include flexible ones, particularly partially acetylated paper supports or paper supports coated with baryta and/or polymers of α-olefin having from 2 to 10 carbon, atoms such as, particularly, polyethylene, polypropylene and ethylene-butene copolymers. Although the support may be either transparent or opaque, transparent supports are preferred.

A backside resistive heating layer, which becomes heat-developable by applying an electric current, as described in U.S. Pat. Nos. 4,460,681 and 4,374,921 can also be used in the heat-developable photographic image system. The photo-thermographic emulsion of the present invention can be applied to the supports by various coating methods such as dip coating, air-knife coating, flow coating, and extruded coating using a hopper as described in U.S. Pat. No. 2,681,294. Two or more layers can be simultaneously formed by methods described in U.S. Pat. No. 2,761,791 and British Patent 837,095.

The photo-thermophotographic products of the present invention can contain additional layers such as a dye-receiving layer to accept a transfer dye image, an opaque layer in cases where reflex printing is desired, a protective top coat layer, and a primer layer known in the heat-developable photographic techniques. The photographic materials of the present invention are preferably capable of forming an image by use of only one sheet thereof. That is, it is not desirable that a functional layer necessary to form an image such as an image-receiving layer is provided on a different photographic material.

The present invention will be illustrated in greater detail below with reference to the following Examples, but the invention should not be construed as being limited thereto.

EXAMPLE 1

840 g of behenic acid and 95 g of stearic acid were added to 12 liters of water, and a solution containing 48 g of sodium hydroxide and 63 g of sodium carbonate in 1.5 liters of water was added to the solution kept at 90° C. After stirring for 30 minutes, the mixture was cooled to 50° C., and then 1.1 liters of an 1% aqueous solution of N-bromosuccinimide and subsequently 2.3 liters of a 17% aqueous solution of silver nitrate were gradually added to the mixture with stirring. Subsequently, after the resulting solution was cooled to 35° C., 1.5 liters of a 2% aqueous solution of potassium bromide was added thereto over a 2-minute period with stirring, and then stirred for 30 minutes, and 2.4 liters of an 1% aqueous solution of N-bromosuccinimide was added to the mixture. After 9 liters of a 2% ethyl acetate solution of poly(vinyl butyral) (average molecular weight 3,000) was added to this aqueous mixture with stirring, the mixture was allowed to stand for 10 minutes to separate into 3 layers. The ethyl acetate layer and the aqueous layer were removed, and the residual gel was washed twice with ethyl acetate. The thus obtained mixture of gelled silver salts of behenic acid/stearic acid and silver bromide was homogenized together with 60 g of poly(vinyl butyral) (average molecular weight 4,000) and 5 liters of isopropyl alcohol to obtain homogenate A. Similarly, homogenate B was prepared by use of 840 g of behenic acid, 52 g of stearic acid and 45 g of arachic acid; homogenate C was prepared by use of 472 g of behenic acid, 172 g of stearic acid and 270 g of arachic acid; and homogenate D was prepared by use of 283 g of behenic acid, 301 g of stearic acid and 316 g of arachic acid.

Homogenates E and F were prepared in the following manner. To an aqueous solution prepared by adding 200 g of gelatin (average molecular weight 70,000), 1.35 liters of 10% phosphoric acid and 0.27 g of potassium bromide to 24 liters of water and kept at 30° C., an aqueous solution containing 4,320 g of silver nitrate and an aqueous solution of potassium bromide were added over a 10-minute period under a constant flow rate of silver nitrate by the control double jet method, while keeping pAg at 8.1. After completing the addition, 880 cc of 1N aqueous solution of sodium hydroxide was added to the mixture. Thereafter, the temperature was raised to 35° C., and soluble salts were removed by the sedimentation method. The emulsion thus prepared contained cubic grains having an average grain size of 0.06 μm and a standard deviation of 10%. At 10 minutes before the addition of silver nitrate in the preparation of homogenate A, the silver bromide emulsion thus prepared was added so as to be 43 g in amount of silver. Further, a similar treatment to that for preparing homogenate A was done, except that 2.05 liters of the aqueous solution of silver nitrate was added and the potassium bromide was not added, thus preparing homogenate E. Similarly to homogenate E, homogenate F was prepared by use of 472 g of behenic acid, 172 g of stearic acid and 270 g of arachic acid.

Coating solutions for emulsion layers were prepared by use of homogenates A to F in the following manner.

| | |
|---|---|
| Each Homogenates | 462 g |
| Dye 1 (as a 0.065% Dimethylformamide Solution) | 60 ml |
| Sodium p-Methylphenylsulfinate (as a 0.01% methanol solution) | 24 ml |
| Phthalazinone | 4.32 g |
| Compound A | 8.4 g |

(Dye 1)

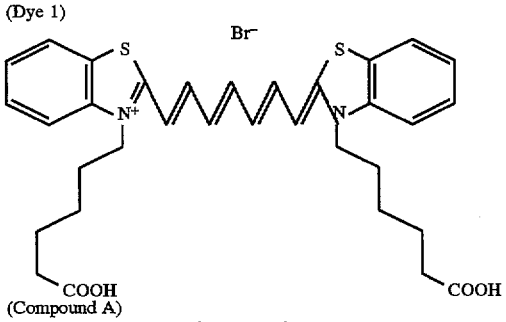

(Compound A)

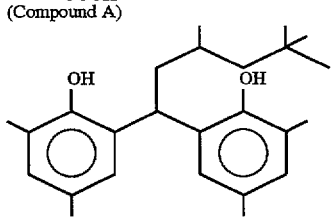

The coating solutions for emulsion coating thus prepared were designated as coating solutions 1 to 6, respectively. Coating solutions prepared by using homogenates A and C and omitting the addition of dye 1 in the above-described formulation were referred to as coating solutions 7 and 8, respectively. Coating solutions having combinations as shown in Table 1 were applied so as to be 2 g/m$^2$ in amount of silver.

A 10% acetone solution of cellulose acetate, which was used for forming the surface protective layers for the emulsion layers, was applied so as to become 2 μm in dry thickness.

A coating solution for the backing layers was prepared according to the following formulation.

| | |
|---|---|
| Poly(vinyl alcohol) | 256 g |
| Deionized Water | 46 g |
| Methanol | 46 g |
| Compound B | 0.05 g |
| Poly(methyl methacrylate) (grain size: 10 μm) | 15.0 g |

(Compound B)

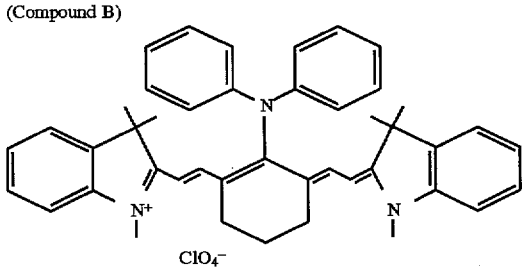

Poly(vinyl alcohol) was added to water with stirring. The temperature was raised to 80° C., and then the mixture was further stirred for 30 minutes. The temperature was reduced to 40° C., and methanol was very gradually added to the mixture with the heaviest stirring. After the mixture was further stirred for 30 minutes, it was cooled to room temperature. This coating solution was applied so as to be 1.2 in absorbance at 810 nm.

Evaluation of Photographic Properties:

The photographic materials were exposed to light with a laser sensitometer equipped with an 810-nm diode, and developed at 120° C. for 15 seconds. Images thus obtained were evaluated by the use of a densitometer. Results of the measurement were evaluated regarding $D_{min}$ and sensitivity (the logarithm of the reciprocal of an exposure amount giving a higher density by 1.0 than $D_{min}$).

Evaluation of Ordinary Aging Storability:

Each of the photographic materials was cut into a size 30.5 cm×25.4 cm with round corners of 0.5 cm in diameter, and allowed to stand under conditions of 25° C.–50% RH for 1 day. Ten sheets of the respective photographic materials were placed in a bag formed of a moistureproof material, hermetically sealed, and allowed to stand at 50° C. for 14 dyes (forced aging test). These samples, and comparative samples which were subjected to a treatment similar to that in the above forced aging test except that the storage temperature was kept at 4° C. were treated in the same manner as in the evaluation of photographic properties to determine the density of fogging areas. Storability to ordinary aging was defined as an increasing ratio of fog.

Increasing Ratio of Fog=[{(Fog of Sample Subjected to Forced Aging Test)−(Fog of Comparative Sample)}/{(The Highest Density of Comparative Sample)−(Density of Support)}]×100

Lower ratio of fog exhibits better storability to ordinary aging.

Evaluation of Image Storability:

The samples after evaluated in terms of photographic properties were exposed to direct sunlight for 14 days, and the degree of discoloration by light was evaluated by visual inspection. Results are shown according to the following grades.

⊙ Little discoloration is observed.

○ Although a slight discoloration is observed, it can be disregarded.

Δ Although some discoloration is observed, it is acceptable in practical use.

x Marked discoloration is observed, and it cannot be accepted in practical use.

About photographic materials 1 to 8, results of the above-described evaluations are shown in Table 1. The sensitivity was represented based on that of photographic material 1 which was defined as 100. Photographic materials 7 and 8 had no sensitivity. Table 1 shows that the photographic materials of the present invention are good in sensitivity, storability to ordinary aging and image storability.

TABLE 1

| Photographic Material | Behenic Acid (mol %) | Stearic Acid (mol %) | Arachic Acid (mol %) | Dye | Sensitivity | $D_{min}$ | Image Storage | Increasing Ratio of Fog | Note |
|---|---|---|---|---|---|---|---|---|---|
| 1 | 89 | 11 | 0 | Contained | 100 | 0.10 | Δ | 32 | Comparative |
| 2 | 89 | 6 | 5 | Contained | 120 | 0.10 | ○ | 1 | Inventive |
| 3 | 50 | 20 | 30 | Contained | 110 | 0.09 | ⊙ | 0 | Inventive |
| 4 | 30 | 35 | 35 | Contained | 40 | 0.20 | x | 5 | Comparative |
| 5 | 89 | 11 | 0 | Contained | 90 | 0.09 | x | 12 | Comparative |
| 6 | 50 | 20 | 30 | Contained | 110 | 0.09 | ○ | 0 | Inventive |
| 7 | 89 | 11 | 0 | Not Contained | 0 | 0.09 | ○ | 5 | Comparative |
| 8 | 50 | 20 | 30 | Not Contained | 0 | 0.09 | ⊙ | 0 | Comparative |

EXAMPLE 2

Similarly to the photographic materials of Example 1, photographic materials 9 to 16 were prepared by combining homogenates A and C with Dyes 2 to 5 (the same molar ratio as that for dye 1) as shown in Table 2, and evaluated in the same manner as in Example 1. The sensitivity was represented based on that of photographic material 10 which was defined as 100. Results are shown in Table 2.

Table 2 shows that the photographic materials of the present invention are good in sensitivity, storability to ordinary aging and image storage.

(Dye 2)

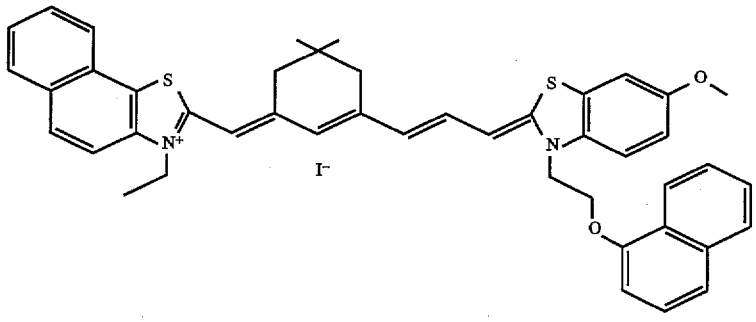

-continued

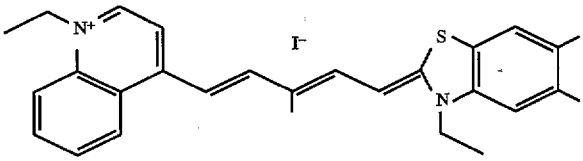

(Dye 3)

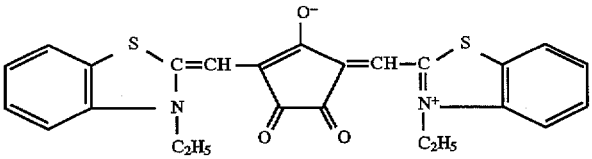

(Dye 4)

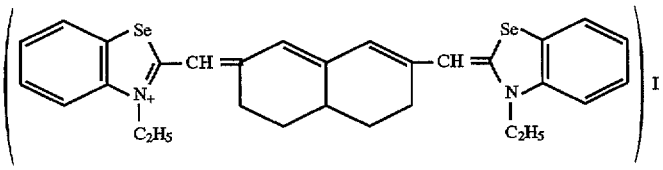

(Dye 5)

TABLE 2

| Photo-graphic Material | Homogenate | Dye | Sensitivity | $D_{min}$ | Image Storage | Increas-ing Ratio of Fog | Note |
|---|---|---|---|---|---|---|---|
| 9 | A | 2 | 90 | 0.08 | Δ | 35 | Comparative |
| 10 | C | 2 | 100 | 0.09 | ◎ | 0 | Inventive |
| 11 | A | 3 | 80 | 0.09 | Δ | 70 | Comparative |
| 12 | C | 3 | 110 | 0.09 | ◎ | 0 | Inventive |
| 13 | A | 4 | 100 | 0.12 | x | 87 | Comparative |
| 14 | C | 4 | 100 | 0.10 | ○ | 1 | Inventive |
| 15 | A | 5 | 90 | 0.09 | ○ | 55 | Comparative |
| 16 | C | 5 | 120 | 0.08 | ◎ | 0 | Inventive |

While the invention has been described in detail and with reference to specific examples thereof, it will be apparent to one skilled in the art that various changes and modifications can be made therein without departing from the spirit and scope thereof.

What is claimed is:

1. A heat-developable silver halide infrared ray-sensitive material comprising a support having on one side of the support an emulsion layer containing a binder, a nonsensitive silver salt, a reducing agent for silver ion and silver halide grains spectrally sensitized at a wavelength within the region of from 750 to 1,400 nm, wherein the nonsensitive silver salt comprises a mixture of silver salts of at least three organic carboxylic acids, one of the acids is behenic acid, and the content of the behenic acid in the acids is from not less than 35 to less than 90 mol %.

2. A heat-developable silver halide infrared ray-sensitive material as claimed in claim 1, wherein the at least three kinds of acids comprises stearic acid and arachic acid as acids other than the behenic acid.

3. A heat-developable silver halide infrared ray-sensitive material as claimed in claim 1, further comprising an antihalation layer provided on the side of the support opposite the emulsion layer, the antihalation layer having an optical density of from not less than 0.3 to not more than 2 at maximum absorption in the wavelength region of from 750 to 1,400 nm and an optical density of from not less than 0.001 to less than 0.5 in the visible region.

4. A heat-developable silver halide infrared ray-sensitive material as claimed in claim 2, further comprising an antihalation layer provided on the side of the support opposite the emulsion layer, the antihalation layer having an optical density of from not less than 0.3 to not more than 2 at maximum absorption in the wavelength region of from 750 to 1,400 nm and an optical density of from not less than 0.001 to less than 0.5 in the visible region.

5. A heat-developable silver halide infrared ray-sensitive material as claimed in claim 1, wherein the content of the behenic acid in the acids is from not less than 40 to less than 80 mol %.

6. A heat-developable silver halide infrared ray-sensitive material as claimed in claim 1, wherein the content of the behenic acid in the acids is from not less than 40 to less than 70 mol %.

7. A heat-developable silver halide infrared ray-sensitive material as claimed in claim 1, wherein the acids comprises an aliphatic carboxylic acid or an aromatic carboxylic acid.

8. A heat-developable silver halide infrared ray-sensitive material as claimed in claim 1, wherein the acids comprise acids selected from the group consisting of oleic acid, lauric acid, caproic acid, myristic acid, palmitic acid, stearic acid, arachic acid, maleic acid, fumaric acid, tartaric acid, linoleic acid, butyric acid and camphoric acid.

9. A heat-developable silver halide infrared ray-sensitive material as claimed in claim 2, wherein the total content of the stearic acid and arachic acid is 10 to 200 mol % based on the molar amount of the behenic acid.

10. A heat-developable silver halide infrared ray-sensitive material as claimed in claim 1, wherein the content of the nonsensitive emulsion layer in the emulsion layer is from 0.5 to 5 $g/m^2$ in weight of silver.

11. A heat-developable silver halide infrared ray-sensitive material as claimed in claim 1, wherein the silver halide grains are spectrally sensitized with the use of a spectrally sensitizing dye in an amount of from about $10^{-5}$ to about 1 mol per mol of silver halide.

12. A heat-developable silver halide infrared ray-sensitive material as claimed in claim 1, wherein the reducing agent comprises a hindered phenol compound.

13. A heat-developable silver halide infrared ray-sensitive material as claimed in claim 1, wherein the content of the reducing agent is from 1 to 10% by weight based on the weight of the emulsion layer.

* * * * *